US010287852B2

(12) United States Patent
Purkis et al.

(10) Patent No.: US 10,287,852 B2
(45) Date of Patent: May 14, 2019

(54) METHOD AND APPARATUS FOR ACTUATING DOWNHOLE TOOLS

(71) Applicant: WEATHERFORD TECHNOLOGY HOLDINGS, LLC, Houston, TX (US)

(72) Inventors: Daniel George Purkis, Cruden Bay (GB); Paul Lincoln Smith, Houston, TX (US); Simon John Harrall, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 526 days.

(21) Appl. No.: 14/654,106

(22) PCT Filed: Mar. 13, 2014

(86) PCT No.: PCT/GB2014/050756
§ 371 (c)(1),
(2) Date: Jun. 19, 2015

(87) PCT Pub. No.: WO2014/140585
PCT Pub. Date: Sep. 18, 2014

(65) Prior Publication Data

US 2015/0369006 A1 Dec. 24, 2015

(30) Foreign Application Priority Data

Mar. 15, 2013 (GB) ..... 1304829.3

(51) Int. Cl.
*E21B 23/04* (2006.01)
*E21B 34/10* (2006.01)
(Continued)

(52) U.S. Cl.
CPC ..... *E21B 34/10* (2013.01); *E21B 23/04* (2013.01); *E21B 41/00* (2013.01); *E21B 47/06* (2013.01); *E21B 47/18* (2013.01)

(58) Field of Classification Search
CPC ..... E21B 230/04; E21B 34/10; E21B 34/108; E21B 43/14; E21B 43/26
See application file for complete search history.

(56) References Cited

U.S. PATENT DOCUMENTS 4,354,524 A * 10/1982 Higgins ..... E21B 43/122 137/624.13
4,403,523 A * 9/1983 Seger ..... F16H 31/005 251/58
(Continued)

FOREIGN PATENT DOCUMENTS

EP 2209967 A2 7/2010
GB 2470286 A 11/2010
(Continued)

OTHER PUBLICATIONS

Dekker, Derk, "International Search Report" for PCT/GB2014/050756, dated Mar. 25, 2015, 7 pages.
(Continued)

*Primary Examiner* — Jennifer H Gay
(74) *Attorney, Agent, or Firm* — Smith IP Services, P.C.

(57) ABSTRACT

A method of actuating at least one of a plurality of downhole tools (10) connected to at least one hydraulic fluid line (L1, L2) is disclosed. The method includes the steps of: a) providing each of the downhole tools with a control unit (20) comprising a timer which permits fluid communication between the at least one hydraulic fluid line and the downhole tool during a window of time; and b) controlling the pressure in the at least one hydraulic fluid line for at least a sufficient period of time required to at least actuate the said downhole tool, wherein the said sufficient period of time coincides at least partially with the said window of time. A control unit for operating one or more than one of a plurality of downhole tools connected to at least one hydraulic fluid line is also disclosed as including a timer associated with
(Continued)

Figure 1:
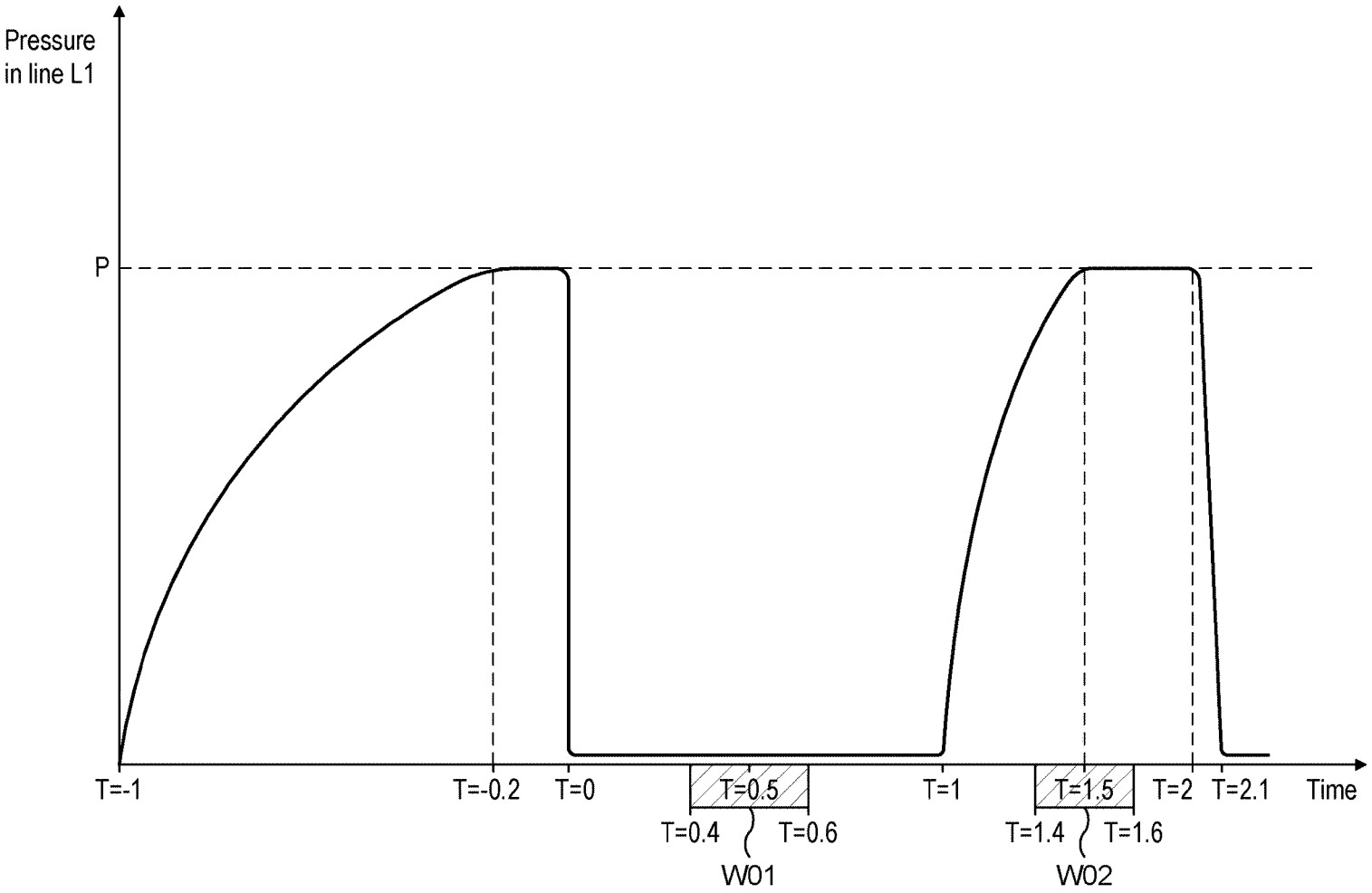

each of the one or more downhole tools, the timer permitting hydraulic fluid to communicate with the respective downhole tool if supplied via the at least one hydraulic fluid line during a window of time. A timer apparatus for use in downhole wellbore for permitting controlled activation of a downhole tool at a point in time is also disclosed as including a valve associated with an energy storage mechanism and which is arranged to move the valve when the energy is released to actuate the downhole tool. A system of downhole tools is also disclosed as including two or more downhole tools, at least one hydraulic fluid line, wherein each of the two or more downhole tools is connected to the at least one hydraulic fluid line and at least one control unit comprising at least one timer, wherein each of the one or more downhole tools is connected to a timer, said timer permitting hydraulic fluid to communicate with the respective downhole tool. A method of controlling flow downhole in a wellbore is also disclosed.

95 Claims, 8 Drawing Sheets

(51) Int. Cl.

| | |
|---|---|
| ***E21B 41/00*** | (2006.01) |
| ***E21B 47/06*** | (2012.01) |
| ***E21B 47/18*** | (2012.01) |

(56) References Cited

U.S. PATENT DOCUMENTS

| | | | | |
|---|---|---|---|---|
| 4,723,474 | A * | 2/1988 | Flohr | E21B 33/0355 251/29 |
| 5,103,906 | A | 4/1992 | Schultz et al. | |
| 6,179,052 | B1 * | 1/2001 | Purkis | E21B 23/04 166/319 |
| 8,188,881 | B2 * | 5/2012 | Mandrou | E21B 34/10 166/375 |
| 8,201,632 | B2 * | 6/2012 | Burnett | E21B 29/00 166/319 |
| 8,602,107 | B2 * | 12/2013 | Reid | E21B 23/04 166/330 |
| 8,794,330 | B2 * | 8/2014 | Stout | E21B 34/10 166/250.01 |
| 9,051,826 | B2 * | 6/2015 | Shaw | E21B 34/10 |
| 9,359,877 | B2 * | 6/2016 | Stout | E21B 34/10 |
| 9,677,381 | B2 * | 6/2017 | Reid | E21B 41/00 |
| 2006/0254763 | A1 * | 11/2006 | Tips | E21B 23/04 166/65.1 |
| 2009/0065213 | A1 * | 3/2009 | Burnett | E21B 29/00 166/319 |
| 2009/0272527 | A1 * | 11/2009 | Cuthill | E21B 43/1195 166/250.01 |
| 2011/0088912 | A1 * | 4/2011 | Reid | E21B 23/04 166/373 |
| 2012/0103628 | A1 * | 5/2012 | Stout | E21B 34/10 166/373 |
| 2012/0138311 | A1 * | 6/2012 | Stout | E21B 34/10 166/373 |
| 2012/0168174 | A1 * | 7/2012 | Vaghi | E21B 34/10 166/373 |
| 2014/0151066 | A1 * | 6/2014 | Reid | E21B 23/04 166/374 |
| 2015/0369006 | A1 * | 12/2015 | Purkis | E21B 23/04 166/250.01 |
| 2017/0226837 | A1 * | 8/2017 | Kumar | E21B 23/01 |

FOREIGN PATENT DOCUMENTS

| | | | |
|---|---|---|---|
| RU | 2291951 | C1 | 1/2007 |
| RU | 2009009196 | A2 | 1/2009 |
| RU | 2010136349 | A | 3/2012 |
| RU | 2468191 | C2 | 11/2012 |
| WO | WO-01/61144 | A1 | 8/2001 |
| WO | WO-2009050517 | A2 | 4/2009 |

OTHER PUBLICATIONS

European Patent Office Machine Translation of RU2291951; Entitled, "System of Overlapping the Flow of the Liquid in the Well", dated Jun. 26, 2018, 8 pages.

European Patent Office Machine Translation of RU2010136349, dated Jun. 28, 2018, 1 page.

* cited by examiner

METHOD AND APPARATUS FOR ACTUATING DOWNHOLE TOOLS

A method of and a control unit for and a timer apparatus for actuating one or more than one of a plurality of downhole tools connected to two hydraulic fluid supply lines, and a system of downhole tools is disclosed, and in other aspects, a method of controlling flow is also disclosed, especially in the borehole of an oil and gas well, and which is preferably but not exclusively able to operate or actuate a selected tool within a period of time referred to herein as a window of opportunity.

BACKGROUND OF THE INVENTION

In recent years it has become more and more important to operators of oil and gas wells to be able to control one or more of a plurality of downhole tools provided in a wellbore completion, such as in the production tubing, in real time. For instance, an operator may wish to be able to control one or more sliding sleeves that are provided in a completion and which are associated with a particular section of production zone of the reservoir because the operator may wish to open or close the sliding sleeve at a particular point in time in order to be able to control flow from that section of the reservoir (for instance if that particular section of reservoir starts to produce a significant amount of water instead of oil or gas) or to be able to control flow from the completion into that section of the reservoir if for instance a water reinjection operation is to be conducted.

With the ongoing quest for hydrocarbon production meaning that new wells are more likely to be more complicated in terms of their reservoir structure, many of such wells have a number of different production zones and it would be very advantageous to the operator of the well to be able to control in real time flow into or flow from each of the separate production zones. It may be that there are five or even ten or more different production zones that would need to be controlled, for instance with a sliding sleeve or another suitable downhole tool for each production zone.

It is an objective of the present invention to offer an alternative and potentially more advantageous control system and method of controlling one or more downhole tools.

According to an aspect of the present invention there is provided a method of actuating at least one of a plurality of downhole tools connected to at least one hydraulic fluid line, wherein the method comprises the steps of:— a) providing each of the downhole tools with a control unit comprising a timer which permits fluid communication between the at least one hydraulic fluid line and the downhole tool during a window of time; and b) controlling the pressure in the at least one hydraulic fluid line for at least a sufficient period of time required to at least actuate the said downhole tool, wherein the said sufficient period of time coincides at least partially with the said window of time.

According to another aspect of the present invention there is provided a system of downhole tools comprising:— two or more downhole tools;

at least one hydraulic fluid line, wherein each of the two or more downhole tools is connected to the at least one hydraulic fluid line; and at least one control unit comprising at least one timer, wherein each of the one or more downhole tools is connected to a timer;

said timer permitting hydraulic fluid to communicate with the respective downhole tool.

According to yet another aspect of the present invention there is provided a method of controlling flow downhole in a wellbore, the method comprising the steps of:— a) installing a plurality of flow control tools downhole, each downhole flow control tool being connected to at least one hydraulic fluid line and each downhole flow control tool being capable of controlling flow downhole from one or more than one selected from:—

1) a completion production tubing into at least one section of downhole reservoir;

2) at least one section of downhole reservoir into a completion production tubing;

3) between an upper and a lower section of completion/production tubing; and 4) between an upper and a lower section of an annuls located between a completion/production tubing and an inner surface of the wellbore;

b) providing each of the downhole flow control tools with a control unit comprising a timer which permits hydraulic fluid to act upon the respective downhole flow control tool if supplied via the at least one hydraulic fluid line during a window of time; and c) providing hydraulic fluid via the hydraulic fluid line to the downhole flow control tool for at least a sufficient period of time required to at least actuate the said downhole flow control tool, wherein the said sufficient period of time coincides at least partially with the said window of time.

According to yet another aspect of the present invention there is provided a control unit for operating one or more than one of a plurality of downhole tools connected to at least one hydraulic fluid line, the control unit comprising:— a timer associated with each of the one or more downhole tools, the timer permitting hydraulic fluid to communicate with the respective downhole tool if supplied via the at least one hydraulic fluid line during a window of time.

Preferably, the timer permits hydraulic fluid to act upon the respective downhole tool if supplied via the at least one hydraulic fluid line.

Preferably, the said window of time is a predetermined window of time.

In one embodiment, controlling the pressure in the at least one hydraulic fluid line could include permits maintaining fluid at a constant pressure in one of said hydraulic fluid lines which is balanced by another of said hydraulic fluid lines and actuation occurs by reducing or bleeding off the pressure in one or the said another of said hydraulic fluid lines.

In another more preferred embodiment, the method comprises providing hydraulic fluid via the said at least one hydraulic fluid line to the downhole tool for at least a sufficient period of time required to at least actuate the said downhole tool, wherein the said sufficient period of time coincides at least partially with the said window of time.

Preferably, step a) further includes providing each of the downhole tools with a valve which is operable by the control unit wherein the control unit is arranged to open the valve at the start of the window of time such that hydraulic fluid is permitted to flow through the valve and is thereby communicated to the respective downhole tool.

Preferably, the hydraulic fluid is permitted to flow through the valve and is thereby permitted to act upon the respective downhole tool.

Preferably, step a) further comprises restricting actuation of the downhole tool outwith the window of time.

Typically, step a) further comprises arranging the timer to close the valve at the end of the window of time such that hydraulic fluid is prevented from flowing through the valve and is thereby prevented from acting upon the respective downhole tool.

Preferably, wherein the timer is arranged such that it times the window of time subsequent to a known instance in time.

Preferably, wherein the said hydraulic fluid is pressurised and the pressure of said hydraulic fluid is increased in the hydraulic fluid line to at least an actuation pressure for a sufficient period of time required to actuate the downhole tool to be actuated.

Preferably, wherein the actuation pressure is a pre-determined actuation pressure.

Optionally, the timer is powered by an electrical power source which is preferably a power source and is at least one of:— located downhole with the timer;

is electrically coupled to the timer; and/or is in close proximity to the timer.

Typically, the control unit comprises a programmable logic unit and is pre-programmed to store data reflecting the said window of time for the respective downhole tool.

Typically, the timer is initiated by a pre-determined event being applied to the said at least one hydraulic fluid line.

Preferably, the pre-determined event is a pressure change in the said hydraulic fluid of the said hydraulic fluid line.

Optionally, the pressure change comprises increasing the pressure of said hydraulic fluid in the said hydraulic fluid line to at least a pre-determined initial setting pressure for a period of time.

Optionally, the timer is initiated by reducing the pressure of said hydraulic fluid in the said hydraulic fluid line to at least a pre-determined minimum pressure.

Optionally, the timer is initiated by reducing the pressure of said hydraulic fluid in the said hydraulic fluid line to at least a minimum threshold pressure where the time that the pressure is at said minimum threshold pressure does not necessarily matter.

Optionally, the timer is initiated by a predetermined rate of change in pressure of said hydraulic fluid in the said hydraulic fluid line.

Optionally, the timer is initiated and powered by the said hydraulic fluid supplied via the said hydraulic fluid line.

Typically, the timer does not require any on board or downhole electrical power supply.

Optionally, the timer comprises a mechanical timing mechanism which may be initiated by the said hydraulic fluid supplied via the said hydraulic fluid line acting upon a moveable member coupled to an energy storage mechanism.

Optionally, the mechanical timing mechanism may be wound up by the said hydraulic fluid supplied via the said hydraulic fluid line acting upon a moveable member coupled to an energy storage mechanism.

Typically, the mechanical timing mechanism further comprises a controlled energy release mechanism which operates at a known rate thereby providing the timer.

Optionally, the mechanical timing mechanism is adapted to open a conduit to bring the selected downhole tool into fluid communication with pressurised hydraulic fluid located in said hydraulic line at the point in time co-incident with the said window of time for that said downhole tool.

Optionally, the mechanical timing mechanism comprises a fluid clock arranged to first store fluid and secondly release fluid at a pre-determined rate.

Typically, step a) is arranged at surface prior to running the downhole tools into a wellbore and step b) is performed at some time after the downhole tools have been run into and situated at depth within the wellbore.

Preferably, each of the downhole tools is provided with a respective control unit.

Optionally, two or more of the downhole tools are connected to a single control unit that is capable of individually controlling each respective downhole tool connected to it.

Optionally, the control system further comprises a pressure monitoring device for monitoring the pressure in the said hydraulic fluid line.

Optionally, there are two hydraulic lines and each of the downhole tools is connected to each of the two hydraulic lines.

Preferably, at least two of the plurality of downhole tools each comprise timers arranged to permit fluid communication with the respective tool during a different window of time.

Preferably, each downhole tool is capable of actuation from a first to a second configuration by application of pressurised fluid via one of the said two hydraulic lines.

Preferably, each downhole tool is capable of actuation from the second to the first configuration by application of pressurised fluid via the other of the said two hydraulic lines.

Typically, the first configuration is an open configuration of the downhole tool and the second configuration is a closed configuration of the downhole tool.

The downhole tool may comprise a third configuration part way between the first and the second configurations.

The two hydraulic lines may be pressure balanced to the surface where no actuation of the respective downhole tool is required during that tool's window of time.

Preferably, there are no more than two hydraulic lines and there are more than two downhole tools.

Typically, the window of time is a pre-determined period of time in which the start of the window is a known point in time to an operator of the downhole tool.

Preferably, the window of time is a pre-determined period of time in which the finish of the window is a known point in time to an operator of the downhole tool.

Preferably, the window of time is a pre-determined period of time in which the start and the finish of each respective window of time for each respective downhole tool is a known point in time to an operator of the downhole tool.

Typically, the control unit further comprises a pressure monitoring device for monitoring the pressure in the said hydraulic fluid line.

Typically, the timer of the control unit is powered by pressurised hydraulic fluid and is initiated when the pressure of the hydraulic fluid corresponds to a predetermined pressure event such that the timer counts the period of time from the predetermined pressure event and is further arranged to permit pressurised hydraulic fluid provided during the window of time to be supplied to the downhole tool associated with that timer such that the downhole tool is actuated.

Optionally, the control unit is mechanically powered and the timer may be powered and/or is initiated by pressurised hydraulic fluid. Optionally, the timer is initiated when the pressure of the hydraulic fluid is changed, said change typically being arranged by the operator. Alternatively, the control unit is electrically powered.

Alternatively, the timer of the control unit is powered by an electrical power supply and is initiated when the pressure of the hydraulic corresponds to a predetermined pressure event such that it counts the period of time from the predetermined pressure event and is further arranged to permit pressurised hydraulic fluid provided during the window of time to be supplied to the downhole tool associated with that timer such that the downhole tool is actuated.

Typically, in relation to the aspect of the system of downhole tools, said timer permits hydraulic fluid to communicate with the respective downhole tool if supplied via the at least one hydraulic fluid line during a window of time and preferably, said timer permits hydraulic fluid to communicate with the respective downhole tool if supplied via the at least one hydraulic fluid line during a predetermined window of time.

According to yet another aspect of the present invention there is provided a timer apparatus for use in downhole wellbore for permitting controlled activation of a downhole tool at a point in time, the timer apparatus comprises:— a valve associated with an energy storage mechanism;

wherein the energy storage mechanism is adapted to store and release energy, and wherein the energy storage mechanism is arranged to move the valve when the energy is released to actuate the downhole tool.

Preferably, the valve is connected to the energy storage mechanism.

Preferably, the valve comprises a piston provided in a cylinder. Preferably, the energy storage mechanism comprises a biasing means and which more preferably comprises a spring mechanism but which alternatively could comprise a compressible fluid or the like.

Preferably, the energy is stored in the energy storage mechanism by movement of the valve is a first direction, and the energy may be released by the energy storage mechanism moving the valve in a second direction.

Preferably, the timer apparatus further comprises a controlled energy release mechanism which operates at a known rate to release the energy stored in the energy storage mechanism thereby providing the timer aspect of the timer apparatus.

Typically, the valve is moved in the first direction by hydraulic fluid pressure acting on a face of the piston and preferably occurs when pressurised hydraulic fluid is introduced into a chamber of the cylinder under the control of an operator of the timer apparatus.

Preferably, a change in the pressure of the fluid in the chamber (which may be a reduction in the pressure) results in withdrawal of fluid from the chamber and which preferably results in movement of the piston in the second direction.

Preferably, said movement of the piston in the second direction occurs after a period of time and more preferably, during the period of time, the valve and more preferably the piston is moved into a predetermined position at which point actuation of the downhole tool can occur.

More preferably, said predetermined position is when the piston is aligned with a hydraulic fluid pathway, said pathway capable of communicating hydraulic fluid which is further capable of actuating the downhole tool.

Typically, the controlled energy release mechanism comprises a fluid flow restriction mechanism and preferably, said pressurised hydraulic fluid is restricted from exiting the said chamber by the fluid flow restriction mechanism.

Typically, the chamber further comprises a fluid flow direction restrictor which preferably permits fluid flow through itself in one direction but prevents fluid flow through itself in the other direction.

Preferably, the said pressurised hydraulic fluid is supplied to said cylinder through one or more conduits from a surface of the wellbore or from a suitable downhole hydraulic fluid supply. More preferably, said one or more conduits are one or more hydraulic lines and most preferably there are two hydraulic lines and most preferably there are no more than two hydraulic lines.

Preferably, each of the downhole tools is connected to each of the two hydraulic lines.

Typically, one timer apparatus is provided for one downhole tool and more preferably a plurality of timers and a respective plurality of downhole tools are incorporated into a system installed downhole in the wellbore, said respective timer apparatus providing timers having either similar or different said periods of time as required by the operator.

The timer apparatus preferably comprises a mechanical timer mechanism and optionally, the mechanical timing mechanism is adapted to open or create a pathway to bring the selected downhole tool into fluid communication with pressurised hydraulic fluid located in said respective hydraulic line at the point in time co-incident with a window of time for that said downhole tool.

Typically, the mechanical timing mechanism comprises a fluid clock arranged to first store fluid and secondly release fluid at a pre-determined rate.

Preferably, at least two of the plurality of downhole tools each comprise timers arranged to permit fluid communication with the respective tool during a different window of time.

Preferably, each downhole tool is capable of actuation from a first to a second configuration by application of pressurised fluid via one of the said two hydraulic lines.

Preferably, each downhole tool is capable of actuation from the second to the first configuration by application of pressurised fluid via the other of the said two hydraulic lines.

Typically, the first configuration is an open configuration of the downhole tool and the second configuration is a closed configuration of the downhole tool.

The downhole tool may comprise a third configuration part way between the first and the second configurations.

The two hydraulic lines may be pressure balanced to the surface where no actuation of the respective downhole tool is required during that tool's window of time.

Preferably, there are no more than two hydraulic lines and there are more than two downhole tools.

Typically, the window of time is a pre-determined period of time in which the start of the window is a known point in time to an operator of the downhole tool.

Preferably, the window of time is a pre-determined period of time in which the finish of the window is a known point in time to an operator of the downhole tool.

Preferably, the window of time is a pre-determined period of time in which the start and the finish of each respective window of time for each respective downhole tool is a known point in time to an operator of the downhole tool.

Typically, the timer apparatus is powered by pressurised hydraulic fluid and is initiated when the pressure of the hydraulic fluid corresponds to a predetermined pressure event such that the timer aspect of the timer apparatus counts the period of time from the predetermined pressure event and is further arranged to permit pressurised hydraulic fluid provided during the window of time to be supplied to the downhole tool associated with that timer apparatus such that the downhole tool is actuated.

Embodiments of the present invention will likely have the advantageous benefit that they allow multiple tools to be operated, preferably independently, with a reduced number of control lines when compared to prior art systems.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features, and advantages of the present invention are readily apparent from the entire description thereof, including the figures, which illustrates a number of exemplary aspects and implementations. Any subject matter described in the specification can be combined with any other subject matter in the specification to form a novel combination. The invention is also capable of other and different examples and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having" "containing" or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or is preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

All numerical values in this disclosure are understood as being modified by "about". All singular forms of elements, or any other components described herein are understood to include plural forms thereof and vice versa.

References to directional and positional descriptions such as upper and lower and directions e.g. "up", "down" etc. are to be interpreted by a skilled reader in the context of the examples described and are not to be interpreted as limiting the invention to the literal interpretation of the term, but instead should be as understood by the skilled addressee. In particular, positional references in relation to the well such as "up" will be interpreted to refer to a direction toward the surface, and "down" will be interpreted to refer to a direction away from the surface and deeper into the well, whether the well being referred to is a conventional vertical well or a deviated well and therefore includes the typical situation where a rig is above a wellhead, and the well extends down from the wellhead into the formation, but also horizontal wells where the formation may not necessarily be below the wellhead.

Embodiments of the present invention will now be described, by way of example only, with reference to the accompanying drawings, in which:—

Figure 2A:
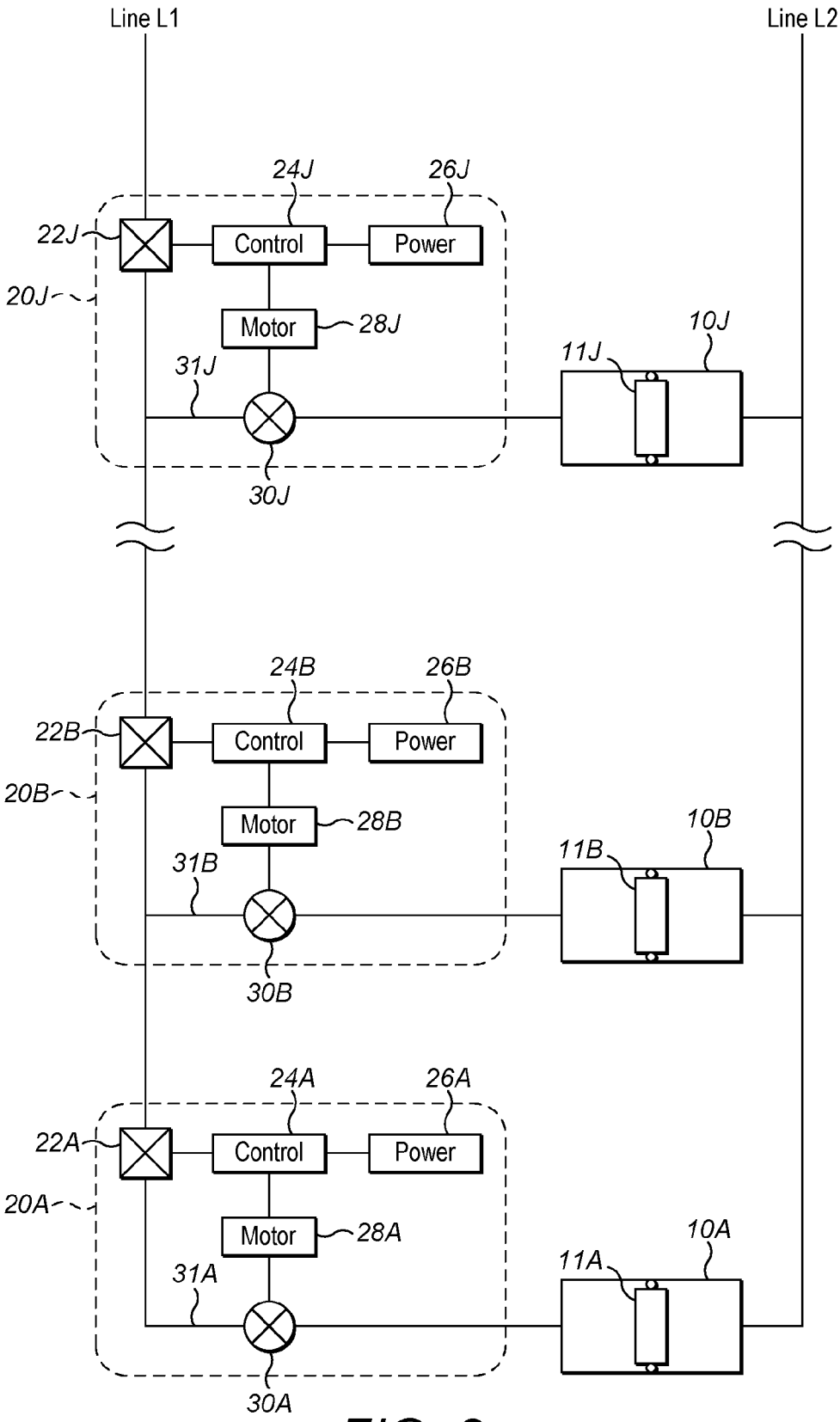
Figure 2B:
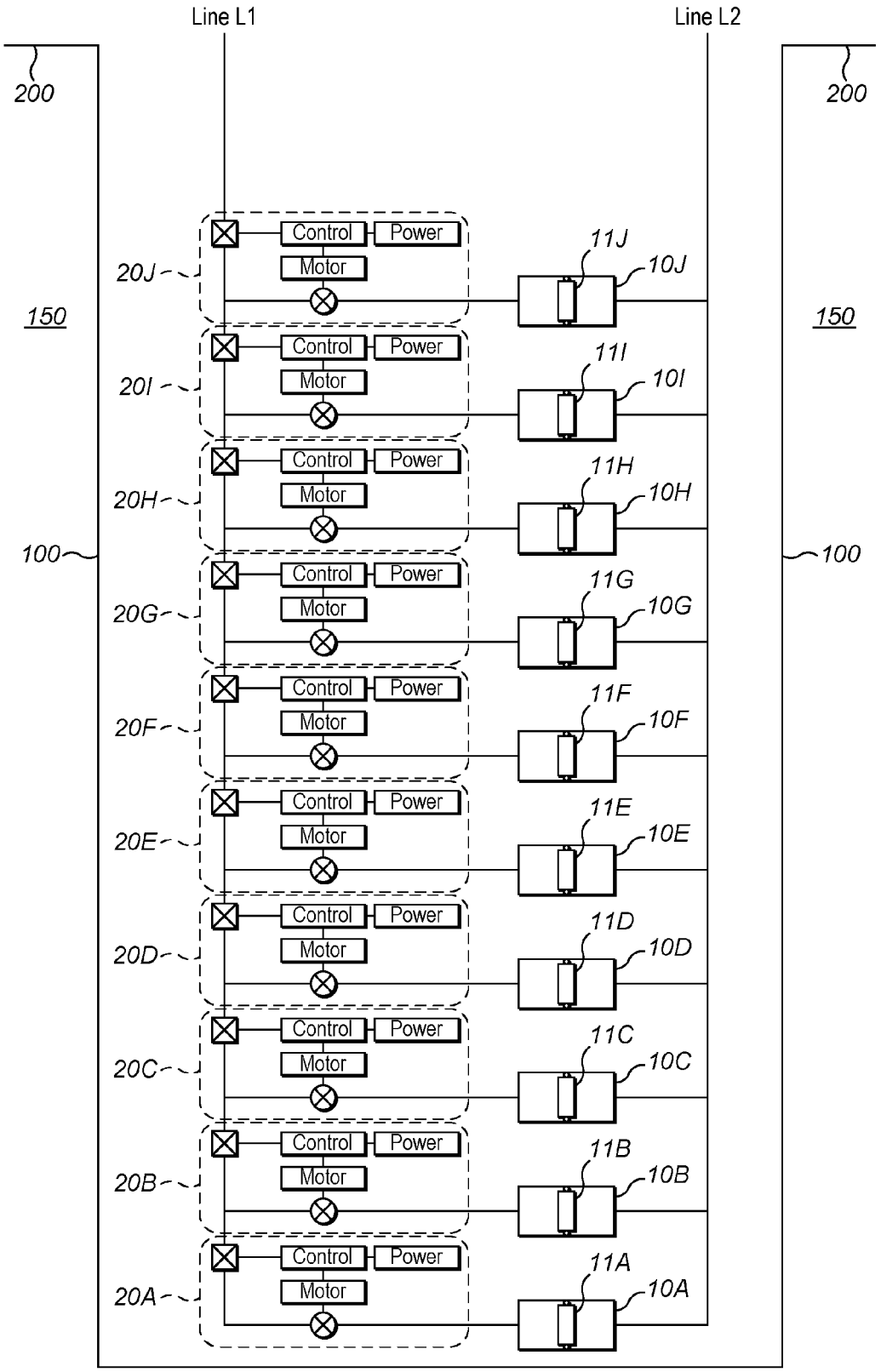
Figure 3A:
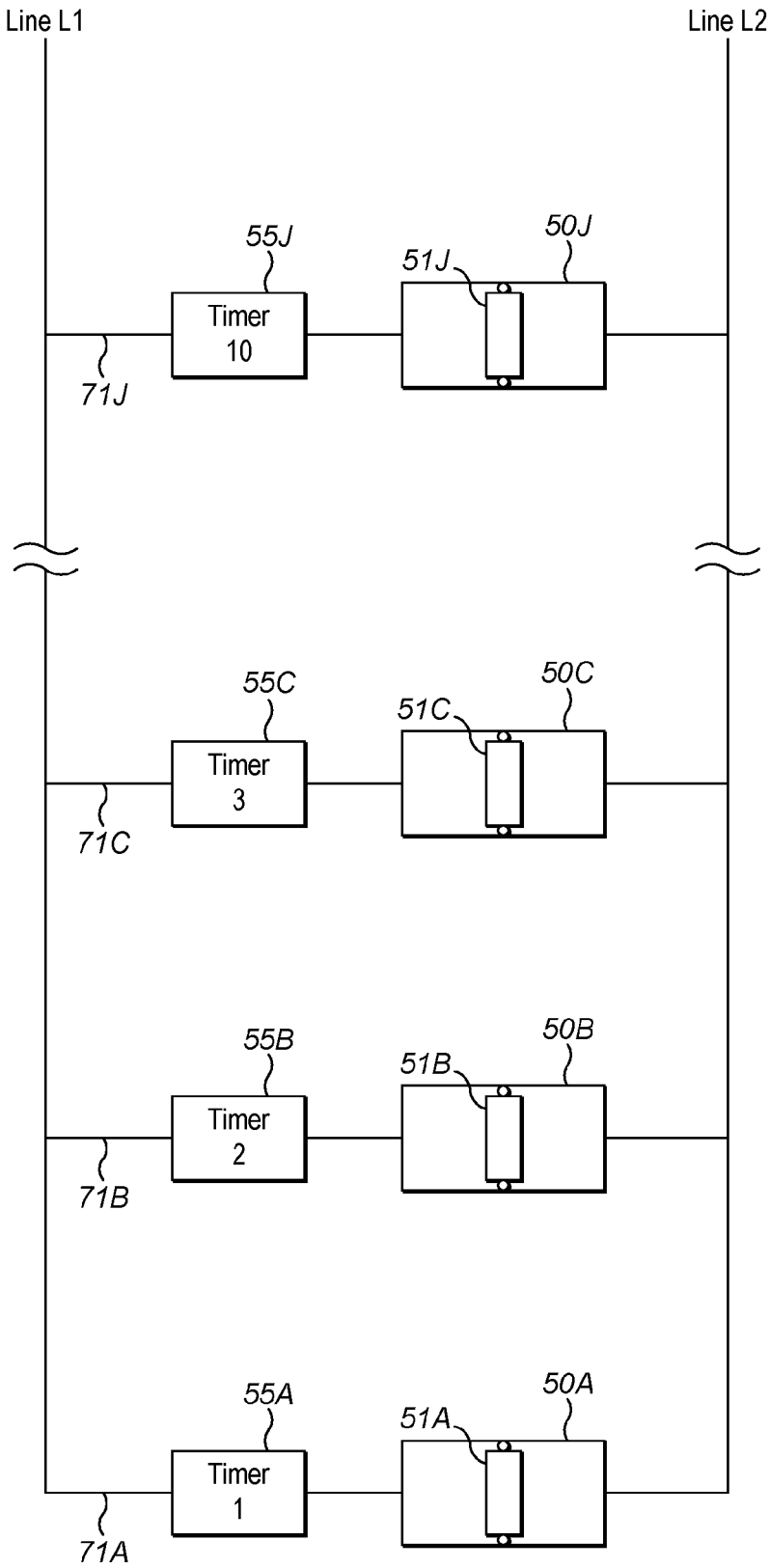
Figure 3B:
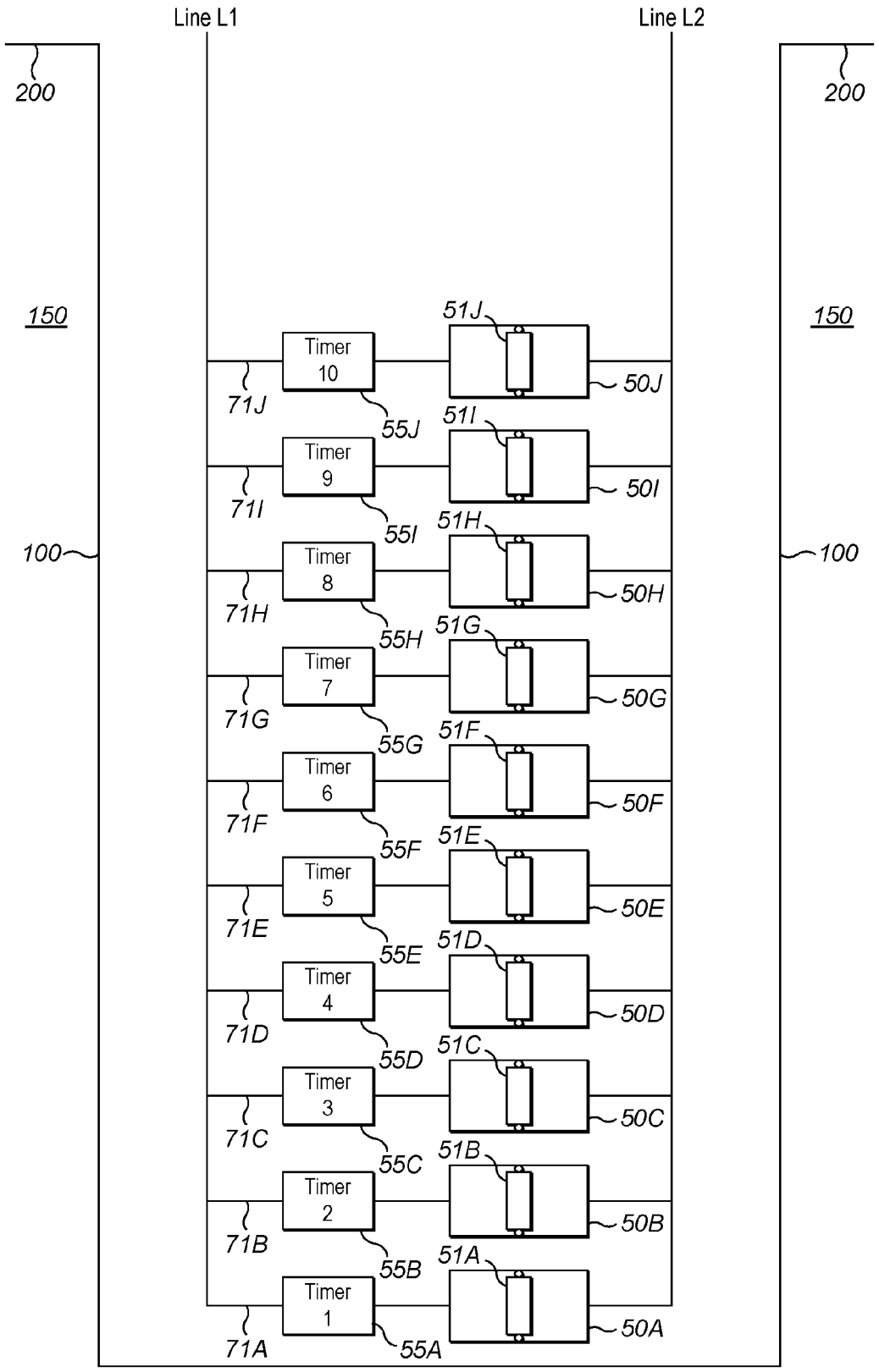
Figure 4A:
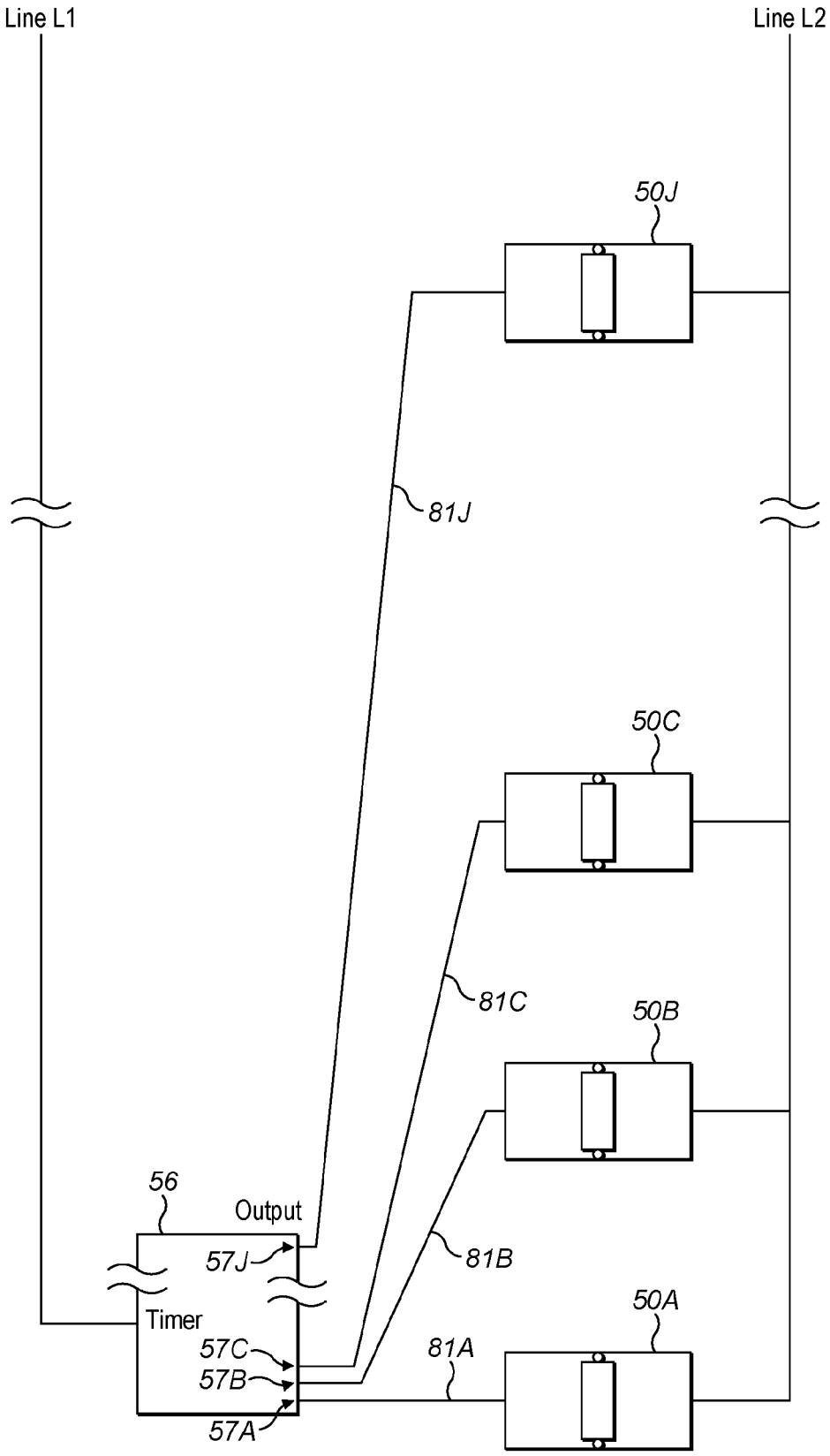
Figure 4B:
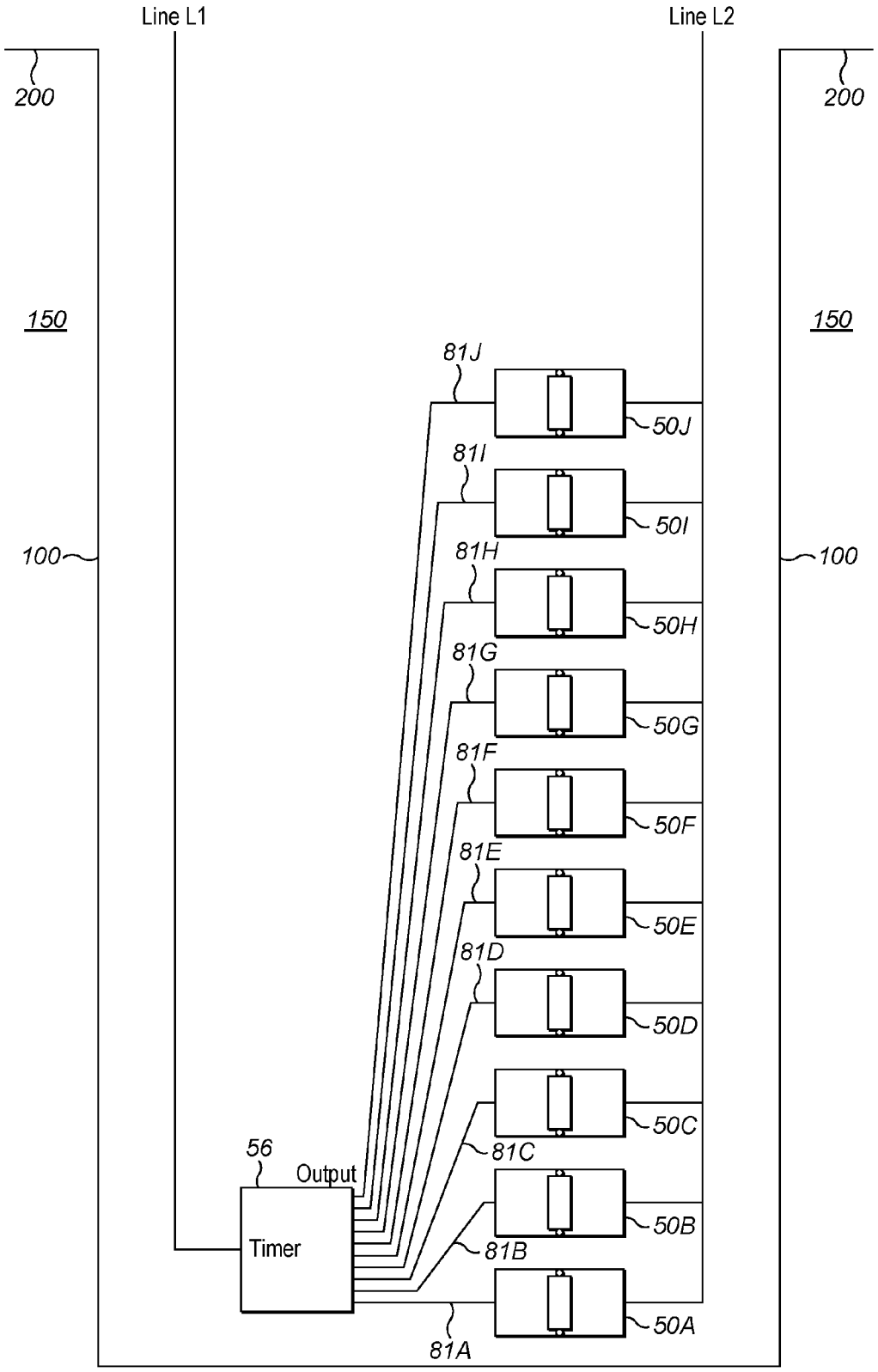
Figure 5:
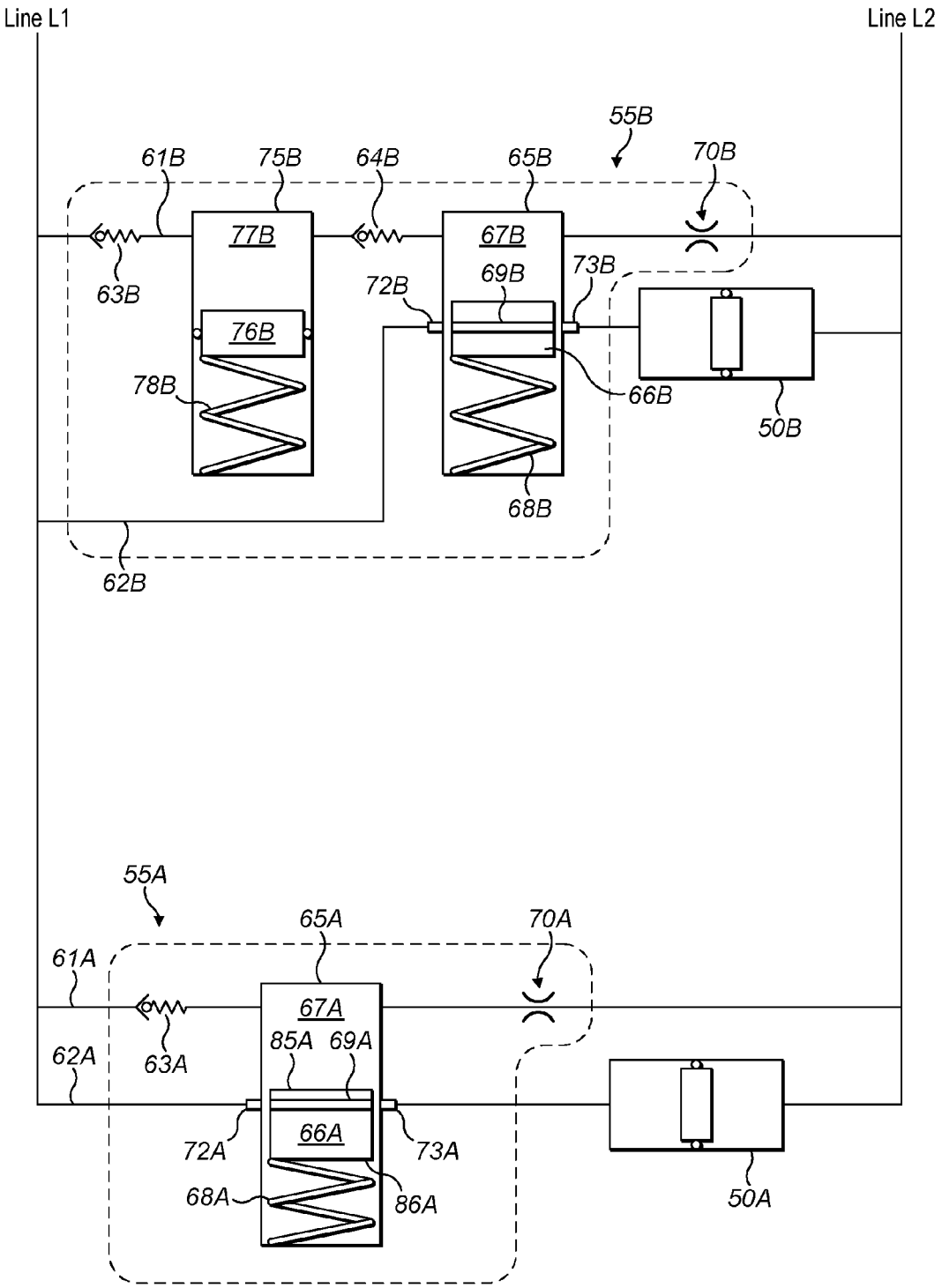

FIG. 1 is a graph showing time (along the X axis or horizontal axis) and pressure of hydraulic fluid in a hydraulic line L1 (along the Y axis or vertical axis) of a downhole control system having been operated in accordance with the present invention over two windows of opportunity to actuate or operate the first two downhole tools in a relatively large number of downhole tools;

FIGS. 2*a* and 2*b* are schematic diagrams showing a pair of hydraulic fluid supply lines A and B installed in a completion in a wellbore and being connected with a plurality (three of which are shown in FIG. 2*a* in detail from for example a total of ten, and ten of which are shown in slightly less detail in FIG. 2*b* within a borehole/wellbore) of downhole tools to be operated by an electrically powered control system in accordance with one or more aspects of the present invention;

FIGS. 3*a* and 3*b* schematic diagrams of a pair of hydraulic fluid supply lines A and B installed in a downhole wellbore completion and being connected to a plurality (four of which are shown from for example a total of ten in FIG. 3*a* in detail and all ten of which are shown in FIG. 3*b* within a borehole/wellbore) of downhole tools located downhole in the wellbore and being controlled by a hydraulically powered timer control system in accordance with one or more aspects of the present invention;

FIGS. 4*a* and 4*b* show a pair of hydraulic fluid supply lines A and B installed downhole in a wellbore completion and being connected to a plurality (four of which are shown in detail in FIG. 4*a* from for example a total of ten, and all ten of which are shown in slightly less detail in FIG. 4*b* within a borehole/wellbore) of downhole tools arranged in the wellbore where a common hydraulically powered timer mechanism is provided that can independently control each of the downhole tools; and FIG. 5 is a schematic diagram of one embodiment of hydraulically powered and controlled timer mechanism that uses a water clock principle to provide a window of opportunity to actuate a downhole tool and therefore provides control over when a pair of respective downhole tools can be actuated in accordance with the present invention.

FIG. 1 shows the pressure in one of the two hydraulic lines (e.g. line L1) that will be used in embodiments of the present invention as will be subsequently described and shows how windows of opportunity are provided over time during which a selected downhole tool can be operated in real time at the choosing of an operator of a downhole wellbore 100 which has been drilled into a reservoir 150 from the surface 200 of the earth or from the subsea surface 200 and which is typically a hydrocarbon bearing/producing reservoir 150.

In accordance with the present invention, and as shown first in FIG. 2, a first embodiment of a control system or unit 20 along with one or more downhole tools 10 are installed in a completion downhole in an oil or gas well 100. Each control system 20 is connected to at least one or more preferably two hydraulic lines L1 and L2. The line or lines are run back to the surface 200 of the wellbore 100 or at least are run to a location in the wellbore 100 where there is a downhole source of hydraulic fluid where pressurised hydraulic fluid can be pumped toward the downhole control unit 20 and downhole tools 10. As will be described subsequently, the control unit 20 is pre-arranged to provide each downhole tool 10 with a window of opportunity during which it can be operated or actuated by pressurised hydraulic fluid in one of the lines L1 and/or L2 during a unique period of time distinct to that downhole tool. The graph in FIG. 1 shows two such windows of opportunity WO1 and WO2 for a respective pair of downhole tools 10A and 10B and the method of pressurising the hydraulic fluid in line L1 to actuate selected tools at different periods of time will now be described referring to FIG. 1. When an operator of the downhole oil or gas well 100 (with the embodiment of the control system installed therein that is in accordance with the present invention and which will be described subsequently) is ready to initiate actuation of a particular downhole tool 10, he increases the pressure of hydraulic fluid in line L1 and that occurrence is shown in the graph of FIG. 1 as occurring at T=−1 where T is any suitable time unit (which may be any fraction of an hour or any multiple of an hour or each integer can represent one hour). The operator continues to increase the pressure in line L1 until the pressure at surface 200 reads a particular pressure P. It does not particularly matter what the exact pressure P is equal to in psi or pascals but it is likely to be a relatively significant level of pressure such as several thousand psi but the particular value is simply one that will be sufficient to initiate, actuate, operate and/or move the various downhole tools 10 that have been installed in the wellbore 100.

The graph of FIG. 1 shows that pressure P has been achieved at T=−0.2. The operator will likely maintain that pressure for a relatively short period of time until the operator is ready to initiate the cycle of controlling the downhole tool 10B he wishes to control. The operator rapidly changes the pressure in the hydraulic line L1 and in this embodiment, the operator rapidly reduces the pressure in line L1 and that event is noted in the graph as having occurred at T=0. As shown in FIG. 1, and as will be described subsequently in more detail, the high negative rate of change of pressure occurring at T=0 represents a signal noted by all the control systems and simultaneously initiates their timers.

The graph also shows that there is a window of opportunity WO1 in the time period from T=0.4 to T=0.6 during which the operator could, if he wished to, operate or actuate the downhole tool 10A that has been predetermined to be possibly actuable during that window of opportunity WO1. Accordingly, at WO1 and as will be detailed subsequently, the control system associated with downhole tool 10A changes the configuration of the downhole tool 10A so that pressure applied in line L1 during WO1 would result in actuation of downhole tool 10A. However, maintaining the pressure in lines A and B during the window WO1 has no effect. In the example shown in FIG. 1, the operator has decided not to actuate the downhole tool 10A associated with the aforementioned first window of opportunity WO1 because the pressure in line L1 is maintained at zero during WO1.

The graph of FIG. 1 shows that the pressure in line L1 is increased at T=1 and the operator has chosen to do that because the operator wishes to actuate the downhole tool 10B that is associated with the window of opportunity WO2 and control system 20B is primed to change the configuration of tool 10B within the time period of between T=1.4 and T=1.6. Accordingly, the operator has increased the pressure in line L1 and that pressure will be used in the window of opportunity WO2 between the time period T=1.4 and T=1.6 to actuate the downhole tool 10B that is associated with that window of opportunity WO2.

The graph of FIG. 1 further shows that at T=2, the operator changes the pressure in line A and in the graph of FIG. 1, this is shown specifically as the operator rapidly reducing the pressure in line A until the pressure in line A=zero or close to zero at T=2.1. As an alternative, the operator could bleed off pressure at any point after T=1.6 or once the operator has received a positive indication of tool actuation.

It should be noted that it is preferable that embodiments in accordance with the method of actuating the downhole tools 10 is initiated at T=zero by a negative going transition in the pressure from a relatively high pressure to a relatively low pressure and this is much preferred because it is more readily possible for an electronics control system to monitor a negative going pressure. However, it will be apparent to a person skilled in the art that the present invention is not limited to just such a negative going transition in the pressure in line L1 in that other methods of initiating the cycle of actuating or operating a downhole tool 10 could be used such as applying a pressure pulse into line L1 or line L2 or another method such as a rapidly increasing the pressure in line L1 or line L2 could also initiate the cycle starting at T=zero.

It should also be noted that there are two hydraulic lines, line L1 and line L2 as will be subsequently described and it should also be noted that the skilled person will realise that line L2 could also be used to initiate the cycle of operating or actuating a selected downhole tool 10 in that the pressure could be increased in line L2 to a similar level and at similar time periods as shown for line L1 in the graph of FIG. 1 if suitable modifications are made to the specific embodiments of the apparatus that will be subsequently described, and such modifications will likely include ensuring that the control unit 20 for the selected downhole tool 10 will be exposed to the pressure in the line L1 or line L2 on the side of the valve 30 to be opened. Alternatively, one line (either A or B) could be used to send the initiation signal at T=0 where the timers are all initiated and the other line (either B or A) is then used as the actuation line.

Accordingly, in FIG. 1, the first window of opportunity that corresponds with a first tool, tool 10A, is indicated as WO1 and extends from the time period T=0.4 to T=0.6 in that that time period has been pre-arranged with the first tool 10A before the first tool 10A is run into the hole (or indeed the first tool 10A is programmed or reprogrammed whilst downhole such that it will be capable of operation or actuation in the time period WO1). Furthermore, FIG. 1 shows a second window of opportunity WO2 as being associated with a second tool 10B and which extends from the time period T=1.4 to T=1.6 and again the second tool 10B has been prearranged or programmed to be capable of being actuated in that time period WO2.

FIG. 2 shows in schematic form a plurality of downhole tools generally indicated by the reference number 10. In this example shown in FIG. 2, there is a first downhole tool 10A, a second downhole tool 10B and where a third downhole tool to a ninth downhole tool are not shown but where there is also shown a tenth downhole tool 10J. There could be more or less than ten downhole tools 10. Typically, the downhole tools 10 will each be installed at various spaced apart locations along a length of a downhole completion production tubing (not shown), where each of the downhole tools 10 can be used to perform various functions for an operator of a downhole oil and/or gas wellbore 100. For instance, the downhole tools 10 could be sliding sleeves or some other sort of fluid flow control device which could be used by an operator to for instance shut off flow from a particular production zone of a reservoir 150 into the production tubing or shut off fluid from flowing from the production tubing into the associated production zone. Alternatively, the operator could wish to fully open the downhole tool 10 to permit fluid to flow from the associated production zone of the reservoir 150 into the production tubing or flow from the production tubing into the reservoir 150 or, if the tool 10 permits partial opening/closing, the operator could operate the tool 10 to partially permit a certain percentage of fluid to flow from the reservoir 150 into the production tubing or be injected from the production tubing into the reservoir 150 as required. However, it should be noted that the downhole tools 10 need not be sliding sleeves as shown in FIG. 2 but indeed could be any other sort of downhole tool that requires or permits operation from the surface 200 at some point in its life time.

In this specific but non-limiting example shown in FIG. 2, each downhole tool 10 will typically be positioned in the production tubing (not shown) at such a point such that when the production tubing is run into the wellbore 100, the downhole tool 10 is located close to or aligned with a particular part of the reservoir 150 of interest to the operator such as a particular production zone and typically which the operator would wish to have some form of control over. It is important to note that the downhole tool(s) 10 may be desired to be operated by the operator relatively quickly after installation (within a matter of hours or days) or could need to spend a considerable amount of time (months or even years) downhole before it is desired to be operated by the operator. Accordingly, each downhole tool 10 will typically have a relatively long life service.

As also shown in FIG. 2, there are two hydraulic fluid supply lines, lines A and B which are typically run from the surface 200 of the wellbore 100 down to at least the location within the wellbore 100 of the lowermost downhole tool which is shown in FIG. 2 as being downhole tool 10A. The two hydraulic lines A and B need not however be run all the way to the surface 200 but could be run to a location toward the upper end of the wellbore 100 at a point that there is a downhole pump and hydraulic fluid supply where the downhole pump is further controllable from the surface 200 of the well 100 by an operator. In most instances however, the hydraulic lines A and B will be run to at least the surface of the well 100. Each hydraulic line L1 and B is capable of transmitting relatively high pressure hydraulic fluid, where the pressure of the hydraulic fluid may be many thousands of psi, such as up to ten thousand psi or even more. As also shown in FIG. 2, only two hydraulic lines A and B are required and no more than two hydraulic lines A and B are required. This is a significant advantage over prior art downhole control systems for controlling multiple downhole tools which would typically require considerably more than two hydraulic lines. Indeed, as shown in FIG. 2, there are ten downhole tools to be connected to each of lines A and B, but as the skilled person in the art will realise, one of the very great advantages of embodiments of the present invention are that there is no theoretical limit on the number of downhole tools 10 that can be connected to the hydraulic lines A and B and indeed there could be many more than ten downhole tools 10 used.

It may also be possible to modify the embodiment shown in FIG. 2 such that there is only one hydraulic line, such as line L1 used in that it may be possible to modify the embodiments shown in FIG. 2 to remove the need for line L2 such that the downhole tool 10 is vented on the side shown as being connected to line L2 in FIG. 2 to the downhole wellbore 100 environment instead of being connected to line L2. However, it is much preferred that there are two hydraulic lines A and B and in particular one of the hydraulic lines is used to allow the hydraulic fluid to be returned back to surface 200. The reason for this is that by having a hydraulic fluid supply line, such as line L1 and a hydraulic fluid return line such as line L2 as shown in FIG. 2, the pressure within the hydraulic lines A and B is balanced to the surface 200 and this avoids complications caused by the alternative system of only one hydraulic line being a hydraulic supply line because the latter alternative embodiment would be balanced to the well 100 and that does have several disadvantages such as having to overcome hydrostatic pressure, etc. Accordingly, for these reasons the two hydraulic lines A and B embodiment of FIG. 2 is much preferred.

Alternatively, another embodiment utilises the configuration where, instead of pressure being reduced to a minimum level, that instead after T=0 a steady pressure is maintained in both lines to balance the tools 10. In this scenario, actuation of a specific tool 10A, 10B, . . . , 10J in its window of opportunity could occur either by:

(i) pressuring one line L1 or B up significantly higher than the other, or (ii) bleeding off pressure in one line L1 or B.

Further alternatively, another embodiment utilises the configuration where, the pressure threshold, P that is reached before setting the timers at T=0 can differ from the pressure applied to actuate the chosen tool 10A, 10B, . . . , 10J in the window of opportunity. The actuation pressure may be higher but is preferably lower than the initiation pressure. This is one way of avoiding a resetting of the timer(s). Another way to avoid resetting of timer(s) is to have a lower bleed off rate so that the negative pressure transition is not as steep and therefore not mistaken for T=0 by control unit electronics.

FIG. 2 also shows a number of electrical power and electrical control units generally designated as 20 where a separate electrically powered and electrically controlled unit 20 is provided for each respective downhole tool 10.

Accordingly, the first downhole tool 10A is provided with a first electrical power and electrical control unit 20A, the second downhole tool 10B is provided with a respective electrical control unit 20B and a tenth downhole tool 101 also being shown as being provided with a respective electrical control unit 201 (the other not shown downhole tools 10C to 101 also being provided with respective electrical control unit 20C to 201). Each electrical control unit 20 comprises a pressure transducer 22 which monitors and/or measures either or both of the actual pressure or the change in pressure of hydraulic fluid located within hydraulic line L1. The pressure transducer can monitor pressure continuously or intermittently, such as every five minutes for example to prolong battery life.

Each of the output of the pressure transducer 22 is input into a respective logic control system 24 which will typically comprise an on-board memory storage device such as a memory circuit provided on an integrated chip and which permits the control system 24 to store information and also typically includes an on-board timer (not shown), both of which are electrically powered by a power supply unit 26 which will typically be a battery or the like which is suitable for an extended period of time of operation downhole (such batteries are known and are capable to be located downhole for extended periods of time such as up to 12 or 24 months).

The control unit 24 has an electrical output which is coupled to an input of an electrical motor 28 which may or may not be provided with a gear box on its output but in any event the output of the motor 28 is connected mechanically to a valve 30, where the valve 30 may be any suitable valve such as a needle valve or ball valve and which can be operated to either fully open or fully close (or indeed partially open or close) the hydraulic fluid supply conduit 31 which leads from line L1 to one side of the downhole tool 10. Consequently, if the downhole valve 30 is fully open, the said one side (the left hand side as shown in FIG. 2) of the respective downhole tool 10 will be in fluid connection with the hydraulic fluid supply line L1 and therefore the pressure of the hydraulic fluid in line L1 will be directly communicated to the said one side of the downhole tool 10. Additionally, if the respective downhole valve 30 is open, the pressure of hydraulic fluid in line L2 which is communicated with and acts upon the other side (the right hand side as shown in FIG. 2) of the respective downhole tool 10 is now able to move the downhole tool 10 in the opposite direction to, for instance, move a sliding sleeve 10 from being fully opened to partially or fully closed. Consequently, when the downhole valve 30 is open, the downhole tool 10 can be fully controlled by an operator at the surface 200 in that the operator can choose to move the downhole tool 10 in one direction by pressurising the hydraulic fluid in line L1 (which in the case of FIG. 2, would move the sliding sleeve 11 from the left hand side to the right hand side) or would permit the operator to fully close the sliding sleeve 11 if the operator pressurises the hydraulic fluid in line L2 (which would move the sliding sleeve 11J from right to left as shown in FIG. 2). On the other hand, if the downhole valve 30 is closed, then its respective downhole tool 10 cannot be moved no matter how much differential pressure one of the lines A or B experiences compared with the other of the lines A and B because the downhole tool 10 and particularly the sliding sleeve 11 would experience hydraulic lock due to the closed downhole valve 30.

A suitable example of a logic control system 24 as including on-board memory and a timer is disclosed in European Patent Publication No EP2209967, and a suitable example of just one form of downhole valve that could be used is the downhole needle valve that is also disclosed in European Patent Publication No EP2209967, the full contents of EP2209967 being incorporated herein by reference.

The operation of the downhole control units 20 for the respective downhole tools 10 as shown in FIG. 2 will now be described with reference to the graph of pressure in line L1 versus time as shown in FIG. 1.

The electrical control unit 20A and in particular the logic control system 24A that is provided for and is associated with the first downhole tool 10A has been pre-arranged or pre-programmed to monitor for a predetermined change in the pressure in line L1 and in the embodiments shown in FIG. 1, the logic control unit 24A is pre-programmed to monitor and watch for a relatively rapidly negative going transition in the pressure in line L1 from pressure P to close to zero pressure as shown as occurring at T=zero. When the logic control system 24A observes that negative going transition, its associated timer (not shown) starts counting. The logic control system 24A has been pre-programmed as shown in FIG. 1 to actuate or electrically power the motor 28A at T=0.4 to open the downhole valve 30A. That event is the start of the window of opportunity or WO1 for the first downhole tool 10A. However, as shown in FIG. 1, the operator has decided not to increase the pressure in line L1 within WO1 because the operator has decided not to actuate or move the first downhole tool 10A. Of course, if the operator did wish to operate the first downhole tool 10A, he would increase the pressure in line L1 preferably shortly before or even at or possibly even during the time period of WO1 and the increasing pressure in line L1 during WO1 would be experienced by the downhole tool 10A and in particular by the shuttle valve 11A such that the shuttle valve 11A would move. Alternatively, as the skilled person will readily understand, the skilled person could decide to increase the pressure in line L2 during the time period of WO1 which would actuate or move the shuttle valve 11A in the opposite direction. In any event, in the example shown in FIG. 1, the operator has decided not to increase the pressure in line L1 during WO1. Instead, as shown in FIG. 1, the operator has decided to increase the pressure in line L1 at T=1 (in advance of the time period of WO2) because the operator has decided to actuate the downhole tool 10B that is associated with and has been pre-programmed to be capable of actuation during the second window of opportunity, WO2 and in this example, that is the second downhole tool 10B. In other words, the second electrical control unit 20B and in particular the second logic control system 24B has been pre-programmed (with the data being stored on its on-board memory) to monitor for the negative going transition in the pressure in line L1 at T=zero and has further been programmed to then power the electrical motor 28B to open valve 30B at the start of the time period of WO2 when the timer instructs it that that time has been reached (in the example shown in FIG. 1, this is T=1.4). In this example, because the operator has furthermore increased the pressure at T=1, by the time that it takes the pressure in line L1 to increase to equal pressure P, the second downhole valve 30B is open and will remain open for the entire period of its window of opportunity WO2 and therefore the pressure in line L1 at T=1.5 (half way through the window of opportunity WO2) will actuate, operate or move the sliding sleeve 11B of the second downhole tool 10B. Of course, it would be up to the operator to instead of increasing the pressure in line L1 during the second window of opportunity WO2, the operator could increase the pressure in line L2 to move the sliding sleeve 11B in the opposite direction to for instance close the sliding sleeve 11B if the operator desired that. The second logic control system 24B will have been pre-programmed to instruct the electrical motor 28B to close the downhole valve 30B at the end of the second window of opportunity WO2 (in the example shown in FIG. 1, this is time=1.6 time units).

In the example shown in FIG. 1, the operator has, once the second window of opportunity WO2 has expired, and at T=2 time units, decided to reduce the pressure in line L1 to zero or close to zero and additional electrical control units 20 for additional respective downhole tools 10 (for instance downhole tools 10C, 10D, 10E, 10F and 10J) will have been pre-programmed to have subsequent windows of opportunity (not shown in the graph of FIG. 1) which will occur after the first WO1 and WO2 windows that are shown in FIG. 1 and therefore the operator could decide to increase the pressure in line L1 or line L2 as appropriate to coincide with those respective subsequent windows of opportunity (not shown). The skilled person will immediately realise that each respective electrical control unit could be provided with more than one window of opportunity and the various respective timings stored in the respective logic control systems 24 could be in any particular order and need not be consecutive from the lowest most downhole tool 10A in the well 100 to the upper most downhole tool 101 in the well 100.

Similarly, it should be noted that the trigger that occurs at time T=zero to start the respective timer mechanisms need not be a rapidly negative going transition in the pressure in line L1 but could be some other event in relation to the pressure in line L1 such as a pressure pulse or indeed a positive going transition. However, a rapidly going negative going transition is preferred because it is more straight forward for the combination of a pressure transducer 22 and logic control system 24 to monitor such a negative going pressure. Additionally, it should be noted that the operator need not have to reduce the pressure to zero or close to zero after T=zero if the control units 20 are configured differently but it is advantageous to reduce the pressure in line L1 to zero following T=zero because the operator will then not actuate or move any downhole tools (such as the first downhole tool 10A) that he does not wish to move, operate or actuate as shown in the graph of FIG. 1 during WO1.

Following passage of time through all of the windows of opportunities, the tools 10 could be dormant again with the transducer taking pressure readings. At a later point in the life of the well 100, an operator can reset the timers by initiating another T=0 event by pressuring up to P followed by rapid bleed off to reset the timers and initiate all the windows of opportunity again.

As will be appreciated by those skilled in the art, the electrically controlled and powered control unit 20 as disclosed in FIG. 2 has a number of advantages in terms of its design, manufacture and deployability within a relatively quick design cycle, but those also skilled in the art will also realise that there are some disadvantages with it in terms of needing to be able to provide downhole power, such as in the form of batteries.

Accordingly, there will now be described a mechanically based system which in some circumstances may be more preferable to the electrical control unit 20 which has been described above in terms of reference to FIG. 2.

FIG. 3 discloses a mechanically based timer unit 55 which is provided for each respective downhole tool 50, where each downhole tool 50 is similar or identical to the downhole tool 10 already described above and therefore will not be further described suffice to say that each downhole tool 50 in FIG. 3 is shown as comprising a sliding sleeve 51 which, in a similar manner to the sliding sleeve 11 already described above, is moveable between an open and a closed position (for example where the open position may be the sliding sleeve 51J being at the far right end of the cylinder in which it is contained and the closed position being for instance the far left end of the cylinder in which it is contained and for example the sliding sleeve 51J can be moved from the closed position (left hand side) to the open position (right hand side) by application of pressurised fluid in line L1 which will act on the left hand side of the sliding sleeve piston 51 and can be moved from the open to the closed position by application of fluid pressure into line L2 because that will act on the right hand side of the sliding sleeve piston 51).

In simple terms, the mechanically based timer 55 is hydraulically actuated and hydraulically powered by hydraulic fluid pressure contained in one of the hydraulic lines, lines A and/or B such that when it is actuated to start a timer, the timer is pre-arranged or pre-programmed to open the hydraulic fluid conduit 71 for at least a set period of time that is pre-determined or known to the operator by for instance opening a valve (not shown) therein, again referred to as a window of opportunity such as WO1 or WO2 as shown in the graph of FIG. 1. Not only is the timer unit 55 started by a pressure event occurring in one of the hydraulic fluid lines A and/or B, but the timer unit 55 is also powered by the force of the pressurised hydraulic fluid in either or both of the hydraulic lines A and/or B, and an embodiment of such a timer unit 55 will be described in detail below with reference to FIG. 5.

Accordingly, the mechanical timer unit 55 which is hydraulically actuated and powered has some major advantages over the electrical control unit 20 of FIG. 2 in that the mechanical timer unit 55 is likely to have a much longer operational capability and indeed is likely to be operable for the entire life of the well 100 which could be ten or twenty or more years.

In terms of operation by the operator of the pressure in line L1 for example, the mechanical timer unit 55 of FIG. 3 is operated in exactly the same way as the electrical control unit 20 of FIG. 2 because each timer unit 55 such as the first timer unit 55A has been designed to have a distinct and unique window of opportunity WO1 when compared to the different window of opportunity WO2 that has been provided for in the design of a second timer unit 55B and the third timer 55C is also provided with a distinct and unique window of opportunity (not shown) as are the rest of the timers 55D, 55E to 55J which are all provided with their own distinct and unique windows of opportunity (not shown). None of the windows of opportunity for the respective tools 50 overlap, but they could do if it was intended that two or more such tools would always be operated synchronously.

FIG. 4 shows an alternative downhole mechanical timer based unit to that of FIG. 3 in that one common timer unit 56 is provided in the alternative unit of FIG. 4 but the single timer unit 56 comprises a number of outputs 57 for each respective downhole tool 50, where the respective outputs 57 are connected to each respective downhole tool 50 via a respective hydraulic fluid supply conduit 81. Consequently, the single timer unit 56 is arranged so that it is both actuated and powered by the hydraulic fluid pressure in one of the hydraulic lines, line L1 and/or line L2 and which will arrange to start a timer at T=zero as shown in FIG. 1 and the single timer unit 56 will arrange to connect the hydraulic line L1 to each of the respective outputs 57A, 57B, 57C to 57J in turn to coincide with that respective tools 50A, 50B, 50C to 50J window of opportunity WO1, WO2 to WO10 such that the respective downhole tool 50A will be actuated if the hydraulic fluid pressure in line L1 is increased to coincide with that respective tools 50 window of opportunity. The advantage of the embodiments shown in FIG. 4 is that only one single downhole timer unit 56 is required but it is likely that this alternative embodiment shown in FIG. 4 will only be most advantageous for wells 100 where the downhole tools 50 are to be located relatively close together so that only relatively short multiple hydraulic conduits 81 need to be run in parallel.

It is envisaged by the inventor that there are many different types of mechanical based timers that are hydraulically actuated and hydraulically powered and could be used in the embodiments of FIGS. 3 and 4, including for example:—

- a clockwork escapement timer such as:—
- a pendulum arrangement;
- a hair spring arrangement that uses the natural frequency of the oscillation of a fly wheel and a spring and this has the advantage over a pendulum that it will likely not be affected by the orientation of the timer mechanism nor outside motion of the timer mechanism;
- a governor mechanism which operates on the principle of two or more spinning masses cantilevered together or other type of clockwork escapement timer mechanism; and/or a water clock type timer mechanism which comprises a container for holding a fluid with a fluid flow restriction or control mechanism.

An example of a water clock mechanical based timer mechanism will now be described but it should be recognised by the skilled person that there are many other different types of mechanical timer units that are capable of being hydraulically actuated and/or hydraulically powered and would therefore be suitable for use in the mechanical timer unit 55.

FIG. 5 shows one embodiment of two slightly different examples of mechanical timer units 55 that are both hydraulically actuated and hydraulically powered, the first example being the first mechanical timer unit 55A for controlling the actuation of the first downhole tool 50A in FIG. 3 and a second mechanical timer unit 55B for controlling the actuation of the second downhole tool 50B of FIG. 3. Further mechanical timer units 55C, 55D to 55J are not shown in FIG. 5 but the skilled person will readily understand that they would be provided using a similar design to for instance the second mechanical timer unit 55B but with for instance larger or longer hydraulic chambers 67B, 77B as will be subsequently described.

The first mechanical timer unit 55A comprises a first hydraulic valve such as a shuttle valve 65A and which itself comprises a hydraulic fluid chamber 67A, a shuttle 66A where one face 85A of the shuttle 66A is exposed to the hydraulic fluid chamber 67A and the other face 86A of the shuttle 66A is coupled to one end of a coiled spring or other suitable spring 68A or any other suitable biasing device, such that the spring 68A biases the shuttle toward the position where it is minimising the volume within the hydraulic fluid chamber 67A. The end of the hydraulic fluid chamber 67A furthest away from the shuttle 66A is connected within a hydraulic conduit 61A which as will be described functions to charge and also actuate the timer 55A. A one way flow valve 63A is provided in the hydraulic conduit 61A in between line L1 and the shuttle valve 65A and is arranged to permit fluid to flow from line L1 into the hydraulic fluid chamber 67A but also acts to prevent fluid from flowing in the reverse direction. Furthermore, in between the hydraulic fluid chamber 67A and line L2 is provided a fluid flow restrictor 70A which acts to restrict the flow of fluid out of the hydraulic fluid chamber 67A and the purpose of which will be described subsequently.

The fluid flow restrictor 70 could be any suitable fluid flow restrictor such as a lee visco jet offered by the Lee Company USA of Connecticut, USA but other fluid flow restrictors are also available and suitable. Ideally, the flow restrictor 70 allows a controlled and known but limited flow rate of hydraulic fluid therethrough. The flow restrictor 70 should also be suitable for use with relatively high viscosity fluids.

Furthermore, an additional hydraulic conduit to the downhole tool 50A is provided in the form of additional hydraulic conduit 62A and which is connected to a fluid input 72A on one side of the shuttle valve 65A, where the fluid output 73A is provided on the other side of the shuttle valve 65A, and importantly, the fluid input 72A and the fluid output 73A are only connected to one another when they are aligned with a fluid path 69 provided on, in or through the shuttle 65. In other words, if the fluid path 69A is not aligned with the fluid input 72A and the fluid output 73A, then no fluid can flow between the fluid input 72A and fluid output 73A and therefore no fluid can flow along the hydraulic conduit 62A to the tool 50A.

The first mechanical timer 55A is operated in accordance with the methodology hereinbefore described and particularly with reference to FIG. 1 in that the operator pressures up line L1 at T=−1 with hydraulic fluid supplied from the surface 200 or from a suitable location in the wellbore 100, and that pressure will mean that hydraulic fluid will flow along hydraulic conduit 61A, through the one way flow valve 63A and will charge the hydraulic fluid chamber 67A in that it 67A will fill up with that pressurised hydraulic fluid and will act to expand the hydraulic fluid chamber 67A such that the shuttle 66A will move downwards as shown in FIG. 5 to compress spring 68A and will move as far down the shuttle valve 65A as possible so that the shuttle 66A is physically located below the position shown in FIG. 5A and therefore such that fluid path 69A is not aligned with the fluid input 72A and fluid output 73A. At time T=0 when the operator makes the fluid pressure transition such as rapidly reducing the pressure in line L1, the shuttle will be biased upwardly by the spring 68A and fluid will flow out of the chamber 67A, through the fluid flow restrictor 70A at a relatively slow (and preferably a known) rate due to the shape and configuration of the restriction caused by the fluid flow restrictor 70A. The fluid flow restrictor 70A can be configured along with the shuttle 66A and the spring 68A to arrange for the fluid path 69A to only be aligned with the fluid input 72A and fluid output 73A during the first window of opportunity WO1. Consequently, if the operator wishes to actuate the first tool 50A, the operator can, just prior to WO1, increase the pressure in line L1 and if that occurs, then the fluid pressure will be transmitted along the hydraulic conduit to the downhole tool 50A via the fluid input 72A, the fluid path 69A through the shuttle and the fluid output 73A. Similarly, if the operator wishes to for instance close the tool 50A, the operator could pressure up line L2 for example and that would move the downhole tool 50A in the opposite direction to for instance close it.

In any event, the shuttle valve 65A and fluid flow restrictor 70A are configured so that when the window of opportunity WO1 for the first tool 50A is to be shut, the fluid path 69A has moved upwards past the fluid input 72A and fluid output 73A such that no further fluid can flow along the hydraulic conduit 62 to the tool 50A.

The second mechanical timer 55B incorporates all the components of the first mechanical timer 55A (and therefore uses the same reference numerals but denoted by the suffix 'B' instead of 'A') but also has some further components in the form of an additional hydraulic cylinder 75B which is located in the hydraulic conduit 61B in between the shuttle valve 65B and the one way flow valve 63B. Indeed, there may optionally be a further one way flow valve 64B provided in the hydraulic conduit 61B and in between the shuttle valve 65B and the additional hydraulic cylinder 75B in order to prevent fluid from flowing back from the shuttle valve 65B into the additional hydraulic cylinder 75B. The additional hydraulic cylinder 75B comprises a piston 76B located therein and a spring 78B which biases the piston 76B to attempt to minimise the volume of the piston fluid chamber 77B. The second mechanical timer 55B is operated in exactly the same way as the first mechanical timer 55A, but the second mechanical timer 55B will be operated to align the fluid path through the shuttle 69B with the input 72B and output 73B during the second window of opportunity WO2 as shown in the graph of FIG. 1, and the additional hydraulic cylinder 75B helps to delay the second window of opportunity WO2 by providing additional hydraulic fluid capacity within its chamber 77B and again the additional hydraulic cylinder 75B can be configured along with the shuttle valve 65B and the fluid flow restrictor 70B to arrange that timing to coincide.

The skilled person will readily understand that further or multiple additional hydraulic cylinders 75 can be provided for each of the respective other downhole tools 50C, 50D to 50J in order to provide further delay for the subsequent windows of opportunity WO3, WO4, WO5 to WO10 to occur and/or the hydraulic fluid chambers 67B and/or 77B can be varied in volume to also vary the occurrence in time of the respective windows of opportunity WO1 to WO10.

Furthermore, the skilled person will readily understand that the mechanical based timers 55A and 55B could be modified within the scope of the invention to provide the single timer 56 unit by for instance providing a shuttle 66 with multiple fluid paths 69A, 69B, 69C to 69J through the shuttle 66 and/or multiple fluid inputs 72 and/or multiple fluid outputs 73 to connect to respective downhole tools 50 such that one shuttle valve 65 could provide separate and distinct outputs 57A, 57B, 57C to 57J as shown in FIG. 4.

The skilled person will also readily understand that there are many other different arrangements of hydraulic circuitry possible to achieve the required control of a downhole tool 50 by allowing the possibility of actuation of the said downhole tool 50 during a period of time referred to as a window of opportunity after a known event has occurred.

Consequently, embodiments of the present invention provide the possibility to an operator to control a virtually unlimited number of downhole tools 10, 50 with only two hydraulic lines A and B (and potentially with just one hydraulic line) and avoid the need for the downhole tools 10, 50 to have respective control systems that operate by monitoring for a distinct pressure value or band of pressure values which in practice is very difficult to do.

Furthermore, the mechanical timer embodiments have the advantage that they do no require any form of downhole electrical power and therefore have a very long life in service, typically at least as long as the well 100 itself.

Modifications and improvements may be made to the embodiments hereinbefore described without departing from the scope of the invention.

For instance, the various embodiments hereinbefore described have been referred to as sensing the pressure in one of the hydraulic lines A or B and in that sense the pressure being sensed is absolute (for instance is 10,000 psi at the pressure transducer 22). Alternatively, it would be possible to measure the differential pressure between lines A and B and in that alternative embodiment, a pressure transducer 22 for each control unit 20 would be provided on each of the lines A and B such that the difference between the pressure in the lines can be measured. Furthermore, FIG. 1 in its graph shows the pressure going down to close to zero. As the skilled person will be aware, it is very unlikely and indeed not possible for the pressure in the hydraulic line L1 or B at a downhole location such as the location of transducers 22 to be zero and therefore the reference to zero pressure is simply a relative zero pressure.

It should also be noted that, whilst the embodiment shown in FIG. 1 as having the timer starting at T=zero and T=zero being initiated by a pressure event in the hydraulic line such as the rapidly decreasing pressure in line L1, it would be possible, particularly for the electrically powered downhole control unit 20 embodiment for the timer to be initiated by some other type of event such as the timer being switched on at the surface 200 at a particular known time and then being run into the borehole because as long as the operator knows exactly what time the timer was initiated, the operator can arrange for the windows of opportunity WO1 to WO10 to be measured from that known point. Furthermore, particularly with the electrical timer embodiment, the timer could simply be referenced to the normal day and night clock such that it operates on the whole or part of the 24 hour clock so that for instance, the window of opportunity WO1 for the first tool 10A is open from for instance 12.30 to 13.00 hours and the window of opportunity WO2 for the second downhole tool 10B is open from 13.30 to 14.00 hours and so on for the rest of the tools 10C to 10J etc.

The invention claimed is:

1. A method of actuating at least one downhole tool connected to at least a first hydraulic fluid line, the method comprising:

increasing pressure in the first hydraulic fluid line;

reducing the pressure in the first hydraulic fluid line, thereby initiating at least one timer;

timing a first time interval with the at least one timer, wherein an end of the first time interval corresponds with a beginning of a second time interval; and then timing the second time interval with the at least one timer, the second time interval being a window of time for actuation of the at least one downhole tool, and wherein the timer is initiated by a predetermined rate of change in pressure in the first hydraulic fluid line.

2. The method according to claim 1, further comprising providing the at least one downhole tool with a valve which is operable by a control unit, wherein the control unit is arranged to open the valve at a start of the window of time such that hydraulic fluid is permitted to flow through the valve.

3. The method according to claim 2, further comprising preventing actuation of the at least one downhole tool outside of the window of time.

4. The method according to claim 2, further comprising closing the valve at an end of the window of time such that the hydraulic fluid is prevented from flowing through the valve and is thereby prevented from acting upon the at least one downhole tool.

5. The method according to claim 4, wherein the window of time is a pre-determined period of time in which the end of the window is a known point in time to an operator of the downhole tool.

6. The method according to claim 2, wherein the control unit comprises a programmable logic unit and is pre-programmed to store data reflecting the window of time for the at least one downhole tool.

7. The method according to claim 2, wherein the timer is initiated and powered by the hydraulic fluid supplied via the first hydraulic fluid line.

8. The method according to claim 2, wherein the control unit further comprises a pressure monitoring device which monitors the pressure in the first hydraulic fluid line.

9. The method according to claim 2, wherein the window of time is a pre-determined period of time in which the start of the window is a known point in time to an operator of the downhole tool.

10. The method according to claim 1, further comprising increasing pressure in the first hydraulic fluid line during the window of time, thereby actuating the at least one downhole tool.

11. The method according to claim 10, wherein the pressure is a pre-determined actuation pressure.

12. The method according to claim 1, wherein the timer is powered by a power source which is at least one of:

located downhole with the timer;

electrically coupled to the timer; and in close proximity to the timer.

13. The method according to claim 1, wherein the timer does not require any on board or downhole electrical power supply.

14. The method according to claim 1, wherein the timer comprises a mechanical timing mechanism which is initiated by the pressure in the first hydraulic fluid line acting upon a moveable member coupled to an energy storage mechanism.

15. The method according to claim 14, wherein the mechanical timing mechanism further comprises a controlled energy release mechanism which operates at a known rate thereby providing the timer.

16. The method according to claim 15, wherein the mechanical timing mechanism is adapted to open a valve at a point in time co-incident with a start of the window of time for the downhole tool.

17. The method according to claim 14, wherein the mechanical timing mechanism comprises a fluid clock arranged to store fluid and then release the fluid at a pre-determined rate.

18. The method according to claim 1, wherein the at least one downhole tool comprises multiple downhole tools, and wherein each of the downhole tools is provided with a respective control unit.

19. The method according to claim 18, wherein a start and an end of each respective window of time for each respective downhole tool is known to an operator of the downhole tools.

20. The method according to claim 1, wherein the at least one downhole tool comprises multiple downhole tools, and wherein the downhole tools are connected to a single control unit that individually controls each of the downhole tools.

21. The method according to claim 1, wherein the at least one downhole tool comprises two or more downhole tools, and wherein the two or more downhole tools are connected to the first hydraulic fluid line.

22. The method according to claim 21, wherein the two or more downhole tools comprise respective timers having different first time intervals.

23. The method according to claim 21, wherein each of the two or more downhole tools is capable of actuation from a first to a second configuration by application of pressurized fluid via the first hydraulic fluid line.

24. The method according to claim 23, wherein each of the two or more downhole tools comprises a third configuration part way between the first and the second configurations.

25. The method according to claim 23, wherein each of the two or more downhole tools is capable of actuation from the second to the first configuration by application of the pressurized fluid via a second hydraulic fluid line.

26. The method according to claim 25, wherein the first configuration is an open configuration of the respective downhole tool and the second configuration is a closed configuration of the respective downhole tool.

27. The method according to claim 1, wherein the first hydraulic fluid line and a second hydraulic fluid line are pressure balanced when no actuation of the downhole tool is desired.

28. A control unit for operating at least one downhole tool connected to at least one hydraulic fluid line, the control unit comprising:

a timer associated with the downhole tool, the timer permitting hydraulic fluid to actuate the downhole tool if supplied via the at least one hydraulic fluid line during a window of time, wherein the timer times an initial time interval followed immediately by a second time interval, and wherein the window of time corresponds to the second time interval.

29. The control unit according to claim 28, further comprising a pressure monitoring device which monitors pressure in the hydraulic fluid line.

30. The control unit according to claim 29, wherein the timer is powered by an electrical power supply and is initiated when the pressure in the hydraulic fluid line corresponds to a predetermined pressure event.

31. The control unit according to 28, wherein the control unit is adapted to operate a valve associated with the downhole tool, and wherein the control unit is arranged to open the valve at the start of the window of time such that the hydraulic fluid is permitted to flow through the valve.

32. The control unit according to claim 31, wherein the control unit is arranged to close the valve at the end of the window of time such that the hydraulic fluid is prevented from flowing through the valve and is thereby prevented from acting upon the downhole tool.

33. The control unit according to claim 28, further comprising a power source which is at least one of:

located downhole with the timer;

electrically coupled to the timer; and in close proximity to the timer.

34. The control unit according to claim 33, wherein the power source is an electrical power source.

35. The control unit according to claim 34, wherein the control unit comprises a programmable logic unit and is pre-programmed to store data reflecting the window of time for the downhole tool.

36. The control unit according to claim 28, wherein the timer is initiated by a pre-determined event applied to the at least one hydraulic fluid line.

37. The control unit according to claim 36, wherein the pre-determined event is a pressure change in the hydraulic fluid in the hydraulic fluid line.

38. The control unit according to claim 28, wherein the timer is initiated and powered by the hydraulic fluid supplied via the hydraulic fluid line.

39. The control unit according to claim 38, wherein the timer does not require any on board or a downhole electrical power supply.

40. The control unit according to claim 38, wherein the timer comprises a mechanical timing mechanism which is initiated by the hydraulic fluid supplied via the hydraulic fluid line acting upon a moveable member coupled to an energy storage mechanism.

41. The control unit according to claim 40, wherein the mechanical timing mechanism further comprises a controlled energy release mechanism which operates at a known rate thereby providing the timer.

42. The control unit according to claim 40, wherein the mechanical timing mechanism is adapted to open a valve at a point in time co-incident with a start of the window of time for the downhole tool.

43. The control unit according to claim 40, wherein the mechanical timing mechanism comprises a fluid clock arranged to store fluid and then release the fluid at a pre-determined rate.

44. The control unit according to claim 28, wherein the at least one downhole tool comprises multiple downhole tools, and wherein the control unit is arranged for connection to a respective one of the downhole tools.

45. The control unit according to claim 28, wherein the at least one downhole tool comprises multiple downhole tools, and wherein the control unit is arranged for connection with the downhole tools and individually controls each of the downhole tools.

46. A system of multiple downhole tools comprising:

at least one hydraulic fluid line, wherein each of the downhole tools is connected to the at least one hydraulic fluid line; and at least one control unit comprising at least one timer, wherein the timer is initiated by a pre-determined event applied to the at least one hydraulic fluid line, and wherein the timer permits hydraulic fluid to actuate a respective downhole tool during a respective window of time which the timer starts and ends, wherein the at least one hydraulic fluid line comprises two hydraulic fluid lines, and wherein each of the downhole tools is connected to both of the hydraulic fluid lines, wherein each of the downhole tools is capable of actuation from a first to a second configuration by application of pressurized fluid via one of the two hydraulic lines, and wherein each of the downhole tools is capable of actuation from the second to the first configuration by application of pressurized fluid via the other of the two hydraulic lines.

47. The system of downhole tools according to claim 46, wherein the timer permits hydraulic fluid to actuate the respective downhole tool if supplied via the at least one hydraulic fluid line during the window of time.

48. The system of downhole tools according to claim 46, wherein the control unit further comprises a pressure device which monitors pressure in the hydraulic fluid line.

49. The system of downhole tools according to claim 48, wherein the timer is arranged to be powered by the hydraulic fluid and is initiated when the pressure in the hydraulic fluid line corresponds to a predetermined pressure event.

50. The system of downhole tools according to claim 48, wherein the system further comprises an electrical power supply.

51. The system of downhole tools according to claim 50, wherein the timer is powered by the electrical power supply and is initiated when the pressure in the hydraulic fluid line corresponds to a predetermined pressure event.

52. The system of downhole tools according to claim 46, wherein the system further comprises a respective valve associated with each of the downhole tools.

53. The system of downhole tools according to claim 52, wherein the control unit is adapted to operate the respective valve associated with each of the downhole tools, and wherein the control unit is arranged to open the valve at a start of the window of time such that hydraulic fluid is permitted to flow through the valve.

54. The system of downhole tools according to claim 53, wherein the control unit is arranged to close the valve at an end of the window of time such that hydraulic fluid is prevented from flowing through the valve and is thereby prevented from acting upon the respective downhole tool.

55. The system of downhole tools according to claim 46, further comprising a power source which is at least one of:

located downhole with at least one of the timer(s);

electrically coupled to the timer(s); and in close proximity to the timer(s).

56. The system of downhole tools according to claim 55, wherein the power source is an electrical power source.

57. The system of downhole tools according to claim 56, wherein the control unit comprises a programmable logic unit and is pre-programmed to store data reflecting the window of time for the respective downhole tool.

58. The system of downhole tools according to claim 46, wherein the pre-determined event is a pressure change in the hydraulic fluid in the hydraulic fluid line.

59. The system of downhole tools according to claim 46, wherein the timer is initiated and powered by the hydraulic fluid supplied via the hydraulic fluid line.

60. The system of downhole tools according to claim 46, wherein the timer does not require any on board or a downhole electrical power supply.

61. The system of downhole tools according to claim 60, wherein the timer comprises a mechanical timing mechanism which is initiated by the hydraulic fluid supplied via the hydraulic fluid line acting upon a moveable member coupled to an energy storage mechanism.

62. The system of downhole tools according to claim 61, wherein the mechanical timing mechanism further comprises a controlled energy release mechanism which operates at a known rate thereby providing the timer.

63. The system of downhole tools according to claim 61, wherein the mechanical timing mechanism is adapted to open a valve at a point in time co-incident with a start of the window of time for the respective downhole tool.

64. The system of downhole tools according to claim 61, wherein the mechanical timing mechanism comprises a fluid clock arranged to store fluid and then release the fluid at a pre-determined rate.

65. The system of downhole tools according to claim 46, wherein a respective control unit is arranged for connection to a respective one of the downhole tools.

66. The system of downhole tools according to claim 46, wherein a single control unit is arranged for connection with the multiple downhole tools and individually controls each of the downhole tools.

67. The system of downhole tools according to claim 46, wherein there are no more than two hydraulic lines and there are more than two of the downhole tools.

68. A method of controlling flow downhole in a wellbore, the method comprising:

installing a plurality of flow control tools downhole, each downhole flow control tool being connected to at least one hydraulic fluid line and each downhole flow control tool controlling flow downhole from one or more than one selected from:

1) a completion production tubing into at least one section of downhole reservoir;

2) at least one section of downhole reservoir into a completion production tubing;

3) between an upper and a lower section of completion/production tubing; and 4) between an upper and a lower section of an annulus located between a completion/production tubing and an inner surface of the wellbore;

providing each of the downhole flow control tools with a timer which permits hydraulic fluid to act upon the respective downhole flow control tool if supplied via the at least one hydraulic fluid line during a window of time, wherein the timer is initiated by a pre-determined event applied to the at least one hydraulic fluid line;

providing each of the downhole flow control tools with a valve, wherein the valve is arranged to open at a start of the window of time such that the hydraulic fluid is permitted to flow through the valve;

providing hydraulic fluid via the hydraulic fluid line to a respective downhole flow control tool during the window of time, thereby actuating the respective downhole flow control tool; and arranging the timer to close the valve at an end of the window of time such that the hydraulic fluid is prevented from flowing through the valve and is thereby prevented from acting upon the respective downhole flow control tool, wherein the at least one hydraulic fluid line comprises two hydraulic fluid lines, and wherein each of the downhole flow control tools is connected to both of the hydraulic fluid lines, wherein each downhole flow control tool is capable of actuation from a first to a second configuration by application of pressurized fluid via one of the two hydraulic fluid lines, and wherein each downhole flow control tool is capable of actuation from the second to the first configuration by application of pressurized fluid via the other of the two hydraulic lines.

69. The method according to claim 68, further comprising preventing actuation of the respective downhole flow control tool outside of the window of time.

70. The method according to claim 68, wherein the timer times the window of time subsequent to a predetermined trigger.

71. The method according to claim 68, further comprising increasing the pressure of the hydraulic fluid in the hydraulic fluid line during the window of time, thereby actuating the respective downhole flow control tool.

72. The method according to claim 71, wherein the pressure is a pre-determined actuation pressure.

73. The method according to claim 68, wherein the timer is powered by a power source which is at least one of:

located downhole with the timer;

electrically coupled to the timer; and in close proximity to the timer.

74. The method according to claim 68, wherein the pre-determined event is a pressure change in the hydraulic fluid in the hydraulic fluid line.

75. The method according to claim 74, wherein the pressure change comprises increasing a pressure of the hydraulic fluid in the hydraulic fluid line.

76. The method according to claim 68, wherein the timer is initiated by reducing a pressure of the hydraulic fluid in the hydraulic fluid line.

77. The method according to claim 68, wherein the timer is initiated by a predetermined rate of change in pressure of the hydraulic fluid in the hydraulic fluid line.

78. The method according to claim 68, wherein the timer is initiated and powered by the hydraulic fluid supplied via the hydraulic fluid line.

79. The method according to claim 68, wherein the timer does not require any on board or downhole electrical power supply.

80. The method according to claim 68, wherein the timer comprises a mechanical timing mechanism which is initiated by the hydraulic fluid supplied via the hydraulic fluid line acting upon a moveable member coupled to an energy storage mechanism.

81. The method according to claim 80, wherein the mechanical timing mechanism further comprises a controlled energy release mechanism which operates at a known rate thereby providing the timer.

82. The method according to claim 81, wherein the mechanical timing mechanism is adapted to open a valve at a point in time co-incident with a start of the window of time for the respective downhole tool.

83. The method according to claim 80, wherein the mechanical timing mechanism comprises a fluid clock arranged to store fluid and then release the fluid at a pre-determined rate.

84. The method according to claim 68, wherein each of the downhole flow control tools is provided with a respective control unit.

85. The method according to claim 84, wherein the control unit comprises a programmable logic unit and is pre-programmed to store data reflecting the window of time for the respective downhole tool.

86. The method according to claim 68, wherein two or more of the downhole flow control tools are connected to a single control unit that individually controls each of the respective downhole tools.

87. The method according to claim 68, wherein the control unit further comprises a pressure monitoring device which monitors the pressure in the hydraulic fluid line.

88. The method according to claim 68, wherein at least two of the downhole flow control tools have different windows of time.

89. The method according to claim 68, wherein the first configuration is an open configuration of the downhole flow control tool and the second configuration is a closed configuration of the downhole flow control tool.

90. The method according to claim 68, wherein the downhole flow control tool may comprise a third configuration part way between the first and the second configurations.

91. The method according to claim 68, wherein the two hydraulic fluid lines are pressure balanced when no actuation of the respective downhole flow control tool is desired.

92. The method according to claim 68, wherein there are no more than two hydraulic fluid lines and there are more than two downhole flow control tools.

93. The method according to claim 68, wherein the window of time is a pre-determined period of time in which a start of the window is a known point in time to an operator of the downhole flow control tool.

94. The method according to claim 68, wherein the window of time is a pre-determined period of time in which an end of the window is a known point in time to an operator of the downhole flow control tool.

95. The method according to claim 68, wherein a start and an end of each respective window of time for each respective downhole flow control tool is known to an operator of the downhole flow control tools.

* * * * *